US005168663A

United States Patent [19]

Klocke

[11] Patent Number: 5,168,663

[45] Date of Patent: Dec. 8, 1992

[54] HAND-HELD SANDING DEVICE

[75] Inventor: Kenneth J. Klocke, Fargo, N. Dak.

[73] Assignee: David Zehr, Fort Wayne, Ind.

[21] Appl. No.: 401,814

[22] Filed: Sep. 1, 1989

[51] Int. Cl.[5] ..... B24D 15/04

[52] U.S. Cl. ..... 51/391; 51/382; 51/358

[58] Field of Search ..... 51/391, 392, 393, 358, 51/363, 382, 383, 406, 407

[56] References Cited

U.S. PATENT DOCUMENTS

| | | | |
|---|---|---|---|
| 1,595,700 | 8/1926 | Backlind | 51/391 |
| 1,782,577 | 11/1930 | Maris | 51/391 |
| 2,103,320 | 12/1937 | Corff | 51/382 |
| 2,804,729 | 9/1957 | Dahlstrom | 51/391 |
| 2,808,687 | 10/1957 | Brown | 51/391 |
| 2,840,959 | 7/1958 | Pritkin | 51/382 |
| 2,922,177 | 1/1960 | Hudson | 51/382 |
| 3,175,334 | 3/1965 | Price et al. | 51/393 |
| 4,688,356 | 8/1987 | Madzgolla | 51/391 |

FOREIGN PATENT DOCUMENTS

| | | | |
|---|---|---|---|
| 0257776 | 11/1986 | Japan | 51/394 |

*Primary Examiner*—Robert A. Rose

*Attorney, Agent, or Firm*—Burd, Bartz & Gutenkauf

[57] ABSTRACT

A laterally flexible and generally inflexible longitudinally hand-held sanding device. The device includes a generally tubular walled body of tough rugged semi-rigid resilient material which is generally cylindrical in its normal relaxed at-rest state. A longitudinal slot extends the length of the body severing the body wall to facilitate lateral flexing. A pair of spaced apart parallel angularly and inwardly extending tapered lips define the opposite sides of that slot. The sander may be flexed to accommodate a variety of contours to be sanded. It may be used in association with sheets of sandpaper or other abrasive material, or abrasive material may be embedded in the body of the sander, either at the outside surface or throughout the body.

17 Claims, 2 Drawing Sheets

FIG. 1
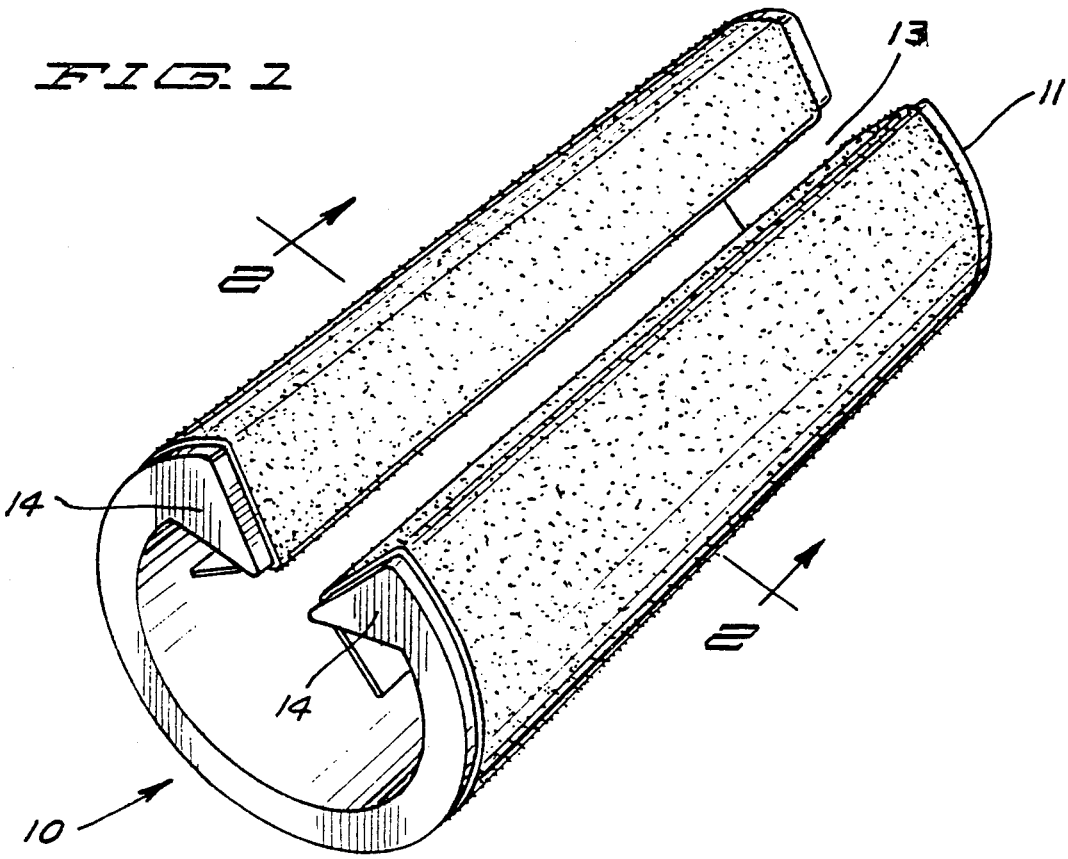
FIG. 2
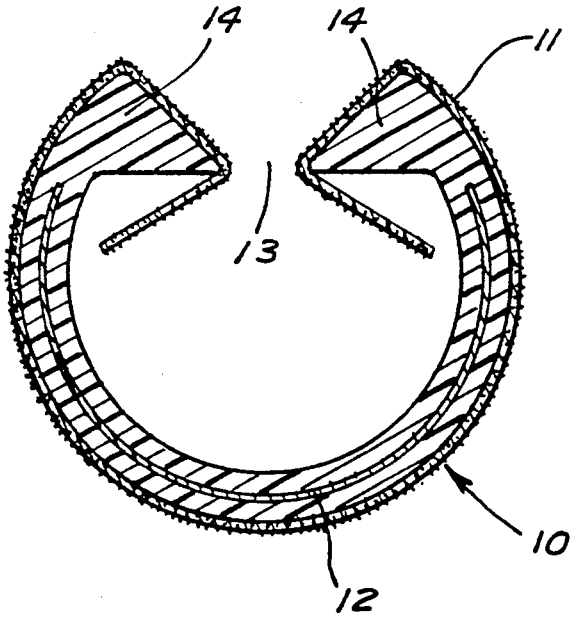
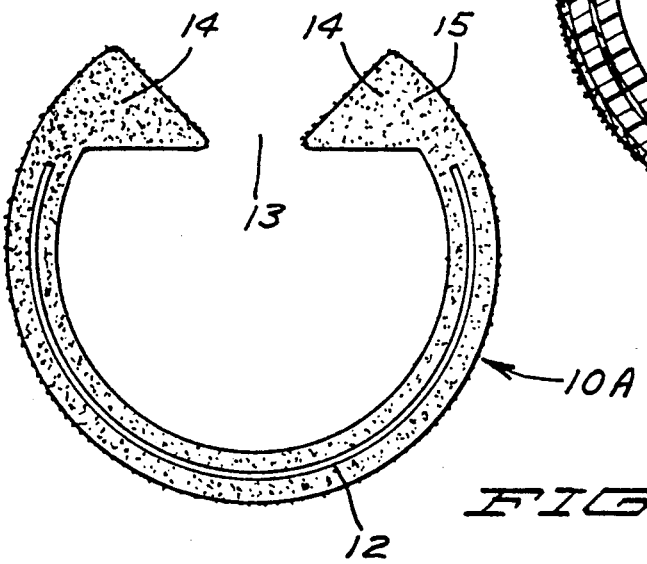
FIG. 3

HAND-HELD SANDING DEVICE

BACKGROUND OF THE INVENTION

1. Field of the Invention

This invention is directed to a hand-held device for smoothing and/or polishing surfaces, such as painted or enameled surfaces. The sander may be used to hold sandpaper or other abrasive sheet material or abrasive material may be embedded in or coated on the surface of the sander. Although not so limited, the sander of this invention is primarily intended for use in sanding non-planar surfaces, such as are encountered in auto body repair and finishing work, and the like. Although equally useful for dry or wet sanding, the device in its preferred form is especially adapted for wet sanding.

1. The Prior Art

The sander of the present invention has evolved from the hand-held sanding device which is the subject of my copending application Ser. No. 196,017, filed May 19, 1988. The sander of that application comprises a hand-held sanding device, for use with sandpaper or other abrasive sheet material, which comprises a generally cylindrical body of semi-resilient material having an outer arcuate face adapted to engage the back surface of a sheet of sandpaper or other abrasive sheet material over at least a substantial portion of that face, and having means for securely holding a sheet of sandpaper or other abrasive sheet material in tight abutting engagement with the body face. Various configurations of sander body structure are disclosed, along with a variety of alternative means for attachment of sandpaper or other abrasive sheet material to the sander body.

SUMMARY OF THE INVENTION

The hand-held sanding device of the present invention is laterally flexible and generally inflexible longitudinally. It comprises a hollow generally tubular walled body of tough semi-rigid resilient material, that body being generally cylindrical in its normal relaxed at-rest state and having a longitudinal slot extending the length of the body and severing the body wall to facilitate lateral flexing of the body. A pair of spaced apart parallel angularly and inwardly extending tapered lips are on opposite sides of the slot. The sander body is adapted to engage the back surface of a sheet of sandpaper or other abrasive sheet material over at least a substantial portion of its outer face. Alternatively, abrasive grit may be embedded in at least the outer face surface of the sander body or abrasive grit may be distributed substantially uniformly throughout the sander body.

BRIEF DESCRIPTION OF THE DRAWINGS

The invention is illustrated by the accompanying drawings in which corresponding parts are identified by the same numerals and in which:

FIG. 1 is a perspective view of the hand-held sanding device shown in its normal relaxed at-rest state with sandpaper or other abrasive sheet material in engagement with the outer body face;

FIG. 2 is a section on the line 2—2 of FIG. 1 and in the direction of the arrows;

FIG. 3 is a similar section showing an alternative form of sander in which abrasive grit is distributed substantially uniformly throughout the sander body;

DETAILED DESCRIPTION OF THE PREFERRED EMBODIMENT

Figure 4:
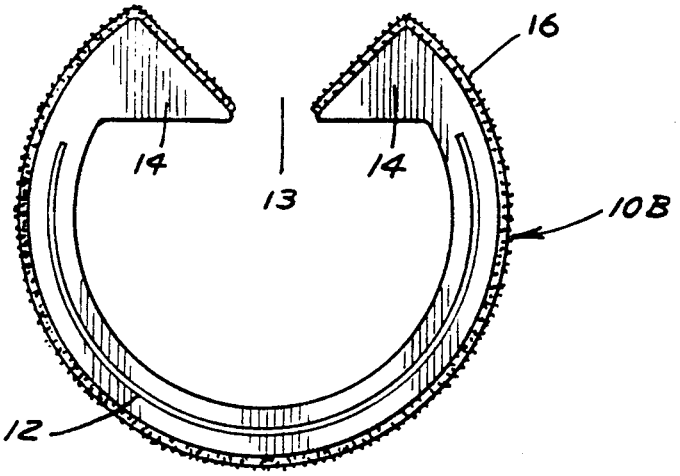
FIG. 4 is a similar sectional view showing a further alternative form of sander in which abrasive grit is embedded in the outer face surface of the sander.

Referring now to the drawings, and particularly to FIGS. 1 and 2, there is shown one form of hand-held sanding device according to the present invention including a hollow generally tubular walled generally cylindrical body, indicated generally at 10, shown in its normal relaxed at-rest state. Body 10 is composed of semi-rigid resilient material so that abrasive sheet material 11 wrapped therearound may be made to conform to arcuate surfaces of varying contours, such as commonly encountered on automobile bodies and similar finishing projects.

Body 10 may be formed from any of a variety of tough rugged synthetic resinous plastic or rubber or rubber-like materials. Exemplary materials are moldable and/or extrudable and include by way of example, polystyrenes and modified polystyrenes, ABS (acrylonitrile-butadiene-styrene) resin, polyvinyl chloride and copolymers thereof, natural rubber, and the like. These materials are formulated so as to be semi-rigid, that is, to be resilient enough to permit lateral flexing and some slight longitudinal deformation under normal manual working pressure. The materials are preferably formulated as closed cell foams so as to be buoyant in water. This facilitates use in wet sanding permitting easy release of accumulated sanded material from the abrasive surface and keeping the sander free from contamination by accumulated debris in the bottom of the water container. Dependent upon the material from which the body is formed, added strength and resilience may be imparted by embedding a C-cross-section spring steel member 12 in the body.

A longitudinal slot 13 extends the length of sander body 10 and severs the body wall. As seen by reference to FIGS. 5 and 6, this facilitates lateral flexing of the body. A pair of spaced apart angularly and inwardly extending tapered lips 14 define the opposite sides of the V-slot 13. The lips 14 are identical and mirror images of one another. They are generally triangular and wedge shaped in cross section having a base integral with the body wall and outer and inner faces. The outer faces of the lips partially define the slot 13 and lie generally in longitudinally extending intersecting planes which intersect at an angle between about 75° to 105° when the body 10 is in its normal relaxed at-rest state, as seen for example in FIG. 2. Thus, the outer arcuate surface of body 10 comprises about 65 to 85 percent of the total peripheral area of the body. As also is apparent from FIG. 2, the inner faces of the lips 14 lie substantially in a common plane when the body is in its normal relaxed at-rest state. The inner and outer faces of the tapered lips intersect with each other at an angle between about 35° and 55°.

Figure 5:
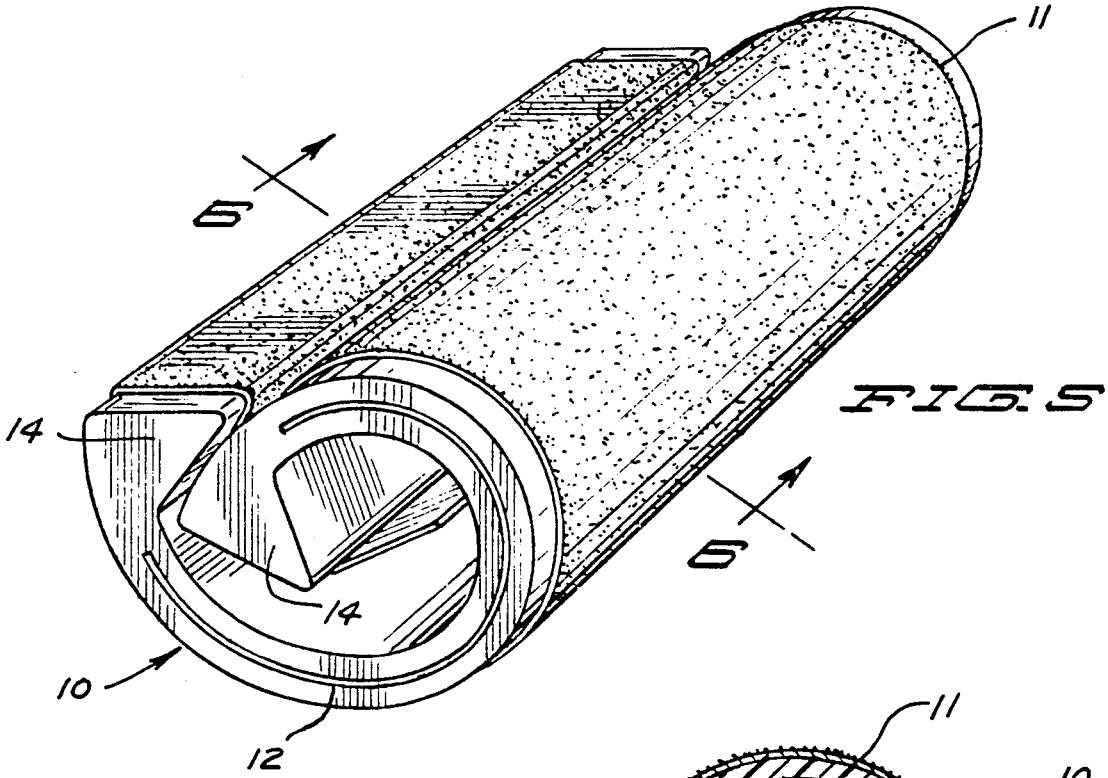
FIG. 5 is a perspective view showing one configuration into which the sander body may be laterally flexed for use.
Figure 6:
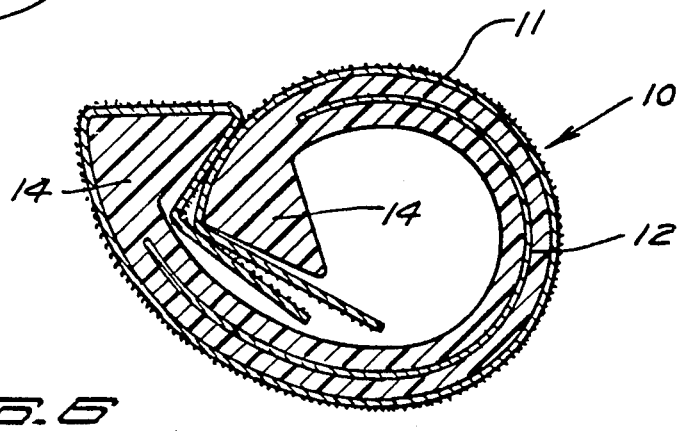
FIG. 6 is a section on the line 6—6 of FIG. 5 and in the direction of the arrows.

The sander body is of a size to be easily held in the hand. Typically it may be about 1½ to 4 inches in diameter and 3 to 6 inches in length with a wall thickness between about 3/16 to ⅜ inch. In use, sandpaper 11 or other abrasive sheet material is wrapped about at least a substantial portion of the face of the body. The sandpaper is preferably first flexed by pulling the paper over a sharp edge one or more times with the grainy side up to permit the sandpaper to be snapped into locked position, as seen in FIGS. 5 and 6, without cracking, splitting, etc. The edges of the flexed sandpaper 11 are inserted through slot 13 and wrapped around the tips of lips 14. The sandpaper may be locked in place by flexing the sander body by squeezing its opposite sides so that the inner face of one lip 14 engages the outer body face adjacent the base of the opposite lip, as seen in FIGS. 5 and 6.

Depending upon which portion of the sandpaper surface is used, a variety of different contours may be sanded. For example, the relatively sharp edge where the outer face of lip 14 intersects the outer body face may be used to sand relatively small grooves and channels and inside corners. The relatively flat surface provided by the outer face of lip 14 and the corresponding outer face of the body adjacent the locked-in lip may be used on flat surfaces. The varying radius contours of the remainder of the sander body may be used as appropriate to the surface being finished. With the sander body in open position, the edge of either lip 14 may be used in small grooves and channels. Similarly, with the body in unlocked position, the body may be flexed to a wide variety of different contours appropriate to the surface being finished.

Instead of using sandpaper or other abrasive sheet material, as seen by reference to FIG. 3, the sander body 10A, which in all other material respects is identical to body 10, may have abrasive particles 15 uniformly distributed throughout the body. Corundum, alumina, silica, and similar well known abrasives may be used in various particle sizes depending upon the particular sanding operation to be performed. Flexing of the body exposes the abrasive particles and as the softer rubber or rubber-like material wears away, more particles are exposed. Instead of distributing the abrasive particles throughout the sander body, as shown in FIG. 4, an adherent coating 16 containing abrasive particles may be applied to the outer surfaces of the sander body 10B. Coating 16 is composed of a suitable rubber or rubber-like coating material having abrasive particles uniformly distributed throughout.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A hand-held sanding device which is laterally flexible and generally inflexible longitudinally, which device comprises:

A) a hollow generally tubular walled body of tough rugged semi-rigid resilient material, said body being generally cylindrical in its normal relaxed at-rest state and having an arcuate outer face, B) a longitudinal slot extending the length of said body and severing the body wall facilitating lateral flexing of the body, C) a pair of spaced apart parallel angularly and inwardly extending tapered lips on opposite sides of said slot, and D) an elongated C-cross-section spring steel member embedded in the body wall between said lips.

2. A sanding device according to claim 1 wherein said body is adapted to engage the back surface of a sheet of sandpaper or other abrasive sheet material over at least a substantial portion of its outer face.

3. A sanding device according to claim 1 wherein said body has abrasive grit embedded in at least its outer face surface.

4. A sanding device according to claim 3 wherein said body has abrasive grit distributed substantially uniformly throughout the body.

5. A hand-held sanding device which is laterally flexible and generally inflexible longitudinally, which device comprises:

A) a hollow generally tubular walled buoyant body of tough rugged semi-rigid resilient material, said body being generally cylindrical in its normal relaxed at-rest state and having an arcuate outer face, B) a longitudinal slot extending the length of said body and severing the body wall facilitating lateral flexing of the body, and C) A pair of spaced apart parallel angularly and inwardly extending tapered lips on opposite sides of said slot.

6. A sanding device according to claim 1 wherein said arcuate outer face extends around about 65 to 85 percent of the periphery of the body when said body is in its normal relaxed at-rest state.

7. A sanding device according to claim 1 wherein the outer faces of said lips lie in longitudinally extending intersecting planes and the inner faces of said lips lie substantially in a common plane when said body is in its normal relaxed at-rest state.

8. A sanding device according to claim 7 wherein said intersecting planes intersect at an angle between about 75° to 105°.

9. A sanding device according to claim 8 wherein the inner and outer faces of each of said tapered lips intersect with each other at an angle between about 35° and 55°.

10. A sanding device according to claim 1 wherein said body is between about 1½ to 4 inches in diameter and said wall thickness is between about 3/16 to ⅜ inch.

11. A sanding device according to claim 1 wherein said body is formed from rubber or synthetic rubber-like material.

12. A hand-held sanding device which is laterally flexible and generally inflexible longitudinally, which device comprises:

A) a hollow generally tubular thick-walled body of tough rugged semi-rigid rubber or rubber-like material, 1) said body being generally cylindrical in its normal relaxed at-rest state and having an arcuate face extending around about 65 to 85 percent of the periphery of the body when said body is in its normal relaxed at-rest state, 2) said body being between about 1½ to 4 inches in diameter, and 3) said wall thickness being between about 3/16 to ⅜ inch, B) an outwardly flaring longitudinal V-slot extending the length of the body and severing the body wall facilitating lateral flexing of the body, and C) a pair of spaced apart parallel angularly and inwardly extending tapered lips on opposite sides of said slot, 1) the outer faces of said lips lying in longitudinally extending planes intersecting at an angle of between about 75° and 105°, and the inner faces of said lips lying substantially in a common plane when said body is in its normal relaxed at-rest state, and 2) the faces of said tapered lips intersecting at an angle between about 35° and 55°.

13. A sanding device according to claim 12 wherein said body is adapted to engage the back surface of a sheet of sandpaper or other abrasive sheet material over at least a substantial portion of its outer face.

14. A sanding device according to claim 12 wherein said body has abrasive grit embedded in at least its outer face surface.

15. A sanding device according to claim 14 wherein said body has abrasive grit distributed substantially uniformly throughout the body.

16. A sanding device according to claim 12 wherein said body has an elongated C-cross-section spring steel member embedded in the body wall between said lips.

17. A sanding device according to claim 12 wherein said sanding device is buoyant.

* * * * *